US009126304B2

(12) United States Patent
Kimura

(10) Patent No.: US 9,126,304 B2
(45) Date of Patent: Sep. 8, 2015

(54) POLISHING PAD

(75) Inventor: Tsuyoshi Kimura, Osaka (JP)

(73) Assignee: TOYO TIRE & RUBBER CO., LTD., Osaka (JP)

( * ) Notice: Subject to any disclaimer, the term of this patent is extended or adjusted under 35 U.S.C. 154(b) by 141 days.

(21) Appl. No.: 13/639,475

(22) PCT Filed: Apr. 7, 2011

(86) PCT No.: PCT/JP2011/058778

§ 371 (c)(1),
(2), (4) Date: Oct. 4, 2012

(87) PCT Pub. No.: WO2011/129254

PCT Pub. Date: Oct. 20, 2011

(65) Prior Publication Data

US 2013/0017769 A1 Jan. 17, 2013

(30) Foreign Application Priority Data

Apr. 15, 2010 (JP) ..... 2010-094318

(51) Int. Cl.
*B24B 37/20* (2012.01)
*B24B 37/22* (2012.01)

(52) U.S. Cl.
CPC ..... *B24B 37/205* (2013.01); *B24B 37/22* (2013.01)

(58) Field of Classification Search
CPC ..... B24B 37/205; B24B 37/22
USPC ..... 451/6, 41, 56, 63, 527–529, 533, 534, 451/537, 539
See application file for complete search history.

(56) References Cited

U.S. PATENT DOCUMENTS 6,454,630 B1 9/2002 Tolles
6,524,164 B1 2/2003 Tolles
6,676,483 B1 1/2004 Roberts (Continued)

FOREIGN PATENT DOCUMENTS

JP 2001-291686 A 10/2001
JP 2003-068686 A 3/2003

(Continued)

OTHER PUBLICATIONS

Taiwan Office Action with Search Report issued by the Taiwan Patent Office, mailed on Dec. 12, 2013 for Taiwan corresponding application No. 100112978.

(Continued)

*Primary Examiner* — Maurina Rachuba
(74) *Attorney, Agent, or Firm* — Law Office of Katsuhiro Arai

(57) ABSTRACT

An object of the present invention is to provide a polishing pad which enables high accuracy optical end-point detection in a state where polishing is carrying out, and which can prevent slurry leakage from a polishing layer to a cushion layer even in the case of being used for a long period. Another object is to provide a method for producing a semiconductor device using the polishing pad. The present invention relates to a polishing pad in which a polishing layer having a polishing region and a light-transmitting region, and a cushion layer having a through hole are laminated via a double-sided adhesive sheet such that the light-transmitting region and the through hole are laid one upon another, wherein a transparent member is stuck on an adhesive layer of the double-sided adhesive sheet in the through hole.

5 Claims, 2 Drawing Sheets

(56) References Cited

U.S. PATENT DOCUMENTS

| | | | | |
|---|---|---|---|---|
| 7,874,894 | B2 * | 1/2011 | Fukuda et al. | 451/6 |
| 2003/0109197 | A1 | 6/2003 | Tolles | |
| 2003/0129931 | A1 | 7/2003 | Konno et al. | |
| 2003/0171070 | A1 | 9/2003 | Tolles | |
| 2004/0235392 | A1 | 11/2004 | Ohta | |
| 2005/0211376 | A1 | 9/2005 | Prasad | |
| 2006/0037699 | A1 | 2/2006 | Nakamori et al. | |
| 2006/0154568 | A1 | 7/2006 | Tolles | |
| 2007/0190905 | A1 | 8/2007 | Shimomura et al. | |

FOREIGN PATENT DOCUMENTS

| | | | |
|---|---|---|---|
| JP | 2003-163191 | A | 6/2003 |
| JP | 2003-285259 | A | 10/2003 |
| JP | 2005-033012 | A | 2/2005 |
| JP | 2007-044814 | A | 2/2007 |
| JP | 2007-276009 | A | 10/2007 |
| JP | 2007-530297 | A | 11/2007 |
| JP | 2008-226911 | A | 9/2008 |
| TW | 200416102 | A | 9/2004 |
| TW | I227254 | B | 2/2005 |
| TW | 200507983 | A | 3/2005 |
| TW | 200600260 | A | 1/2006 |

OTHER PUBLICATIONS

A Notification of First Office Action with Search Report issued by the State Intellectual Property Office of China, mailed Jan. 20, 2014, for Chinese counterpart application No. 201180006998.0.

Notification of Reasons for Refusal issued by the Japanese Patent Office, mailed Sep. 20, 2013, for Japanese counterpart application No. 2010-094318.

Final Office Action issued by the Korean Intellectual Property Office, mailed on Dec. 17, 2013, for Korean counterpart application No. 10-2012-7016954.

Final Office Action issued by the Korean Intellectual Property Office, mailed on Oct. 31, 2013, for Korean counterpart application No. 10-2012-7016954.

A Notice to Submit a Response issued by the Korean Intellectual Property Office, mailed on Jun. 1, 2013, for Korean counterpart application No. 10-2012-7016954.

A Notification of Examination Opinions with Search Report issued by Taiwan Intellectual Property Office, mailed Jun. 11, 2014, for Taiwan counterpart application No. 100112978.

A Notification of Reasons for Refusal issued by the Japanese Patent Office, mailed Apr. 22, 2014, for Japanese counterpart application No. 2010-094318.

* cited by examiner

POLISHING PAD

This application is the U.S. National Phase under 35 U.S.C. §371 of International Application PCT/JP2011/058778, filed Apr. 7, 2011 which claims priority to Japanese Patent Application No. 2010-094318, filed Apr. 15, 2010. The International Application was published under PCT Article 21(2) in a language other than English.

TECHNICAL FIELD

The present invention relates to a polishing pad used in planarizing an uneven surface of a material to be polished, such as a semiconductor wafer, by chemical mechanical polishing (CMP) and in particular to a polishing pad having a window (light-transmitting region) for detection of a polished state or the like by optical means, as well as a method for producing a semiconductor device by using the polishing pad.

BACKGROUND ART

Production of a semiconductor device involves a step of forming an electroconductive film on a surface of a semiconductor wafer (hereinafter also referred to as a wafer) to form a wiring layer by photolithography, etching or the like; a step of forming an interlaminar insulating film on the wiring layer; and the like; and an uneven surface made of an electroconductive material such as metal and an insulating material is formed on the surface of a wafer by these steps. In recent years, processing for fine wiring and multilayer wiring have been advancing for the purpose of higher integration of semiconductor integrated circuits, and accordingly techniques of planarizing an uneven surface of a wafer have become important.

As the method of planarizing an uneven surface of a wafer, a CMP method is generally used. CMP is a technique in which while the surface of a wafer to be polished is pressed against a polishing surface of a polishing pad, the surface of the wafer is polished with an abrasive in the form of slurry having abrasive grains dispersed therein (hereinafter, referred to as slurry).

As shown in FIG. 1, a polishing apparatus used generally in CMP is provided, for example, with a polishing platen 2 for supporting a polishing pad 1; a supporting stand (polishing head) 5 for supporting a polished material (wafer) 4; a backing material for uniformly pressurizing a wafer; and a mechanism of feeding an abrasive 3. The polishing pad 1 is fitted with the polishing platen 2, for example, by sticking with a double-sided tape. The polishing platen 2 and the supporting stand 5 are provided with rotating shafts 6 and 7, respectively, and are arranged such that the polishing pad 1 and the polished material 4, both of which are supported by them, are opposed to each other. The supporting stand 5 is provided with a pressurizing mechanism for pressing the polished material 4 against the polishing pad 1.

When such CMP is conducted, there is a problem of judging the planarity of wafer surface. That is, the point in time when desired surface properties or planar state are reached is required to be detected. With respect to the thickness of an oxide film, polishing speed and the like, the following has been conventionally conducted that a test wafer is periodically treated, the results are confirmed, and thereafter a wafer to be a product is subjected to a polishing treatment.

In this method, however, the treatment time of a test wafer and the cost for the treatment are wasteful, and the test wafer not subjected to processing at all in advance and a product wafer are different in polishing results due to a loading effect unique to CMP, and accurate prediction of processing results is difficult without actual processing of the product wafer.

Accordingly, there has been a need in recent years for a method capable of in situ detection of the point in time when desired surface properties and thickness are attained at the time of CMP processing, in order to solve the problem described above. In such detection, various methods are used. From the viewpoints of measurement accuracy and spatial resolution in non-contract measurement, optical detection means comes to be used mainly.

The optical detection means is specifically a method of detecting the end-point of polishing by irradiating a wafer via a polishing pad through a window (light-transmitting region) with light beam, and monitoring interference signal generated by reflection of the light beam.

As a method of detecting the end-point of polishing by such optical means, and a polishing pad used in the method, various methods and polishing pads have been proposed.

For example, there has been proposed a polishing pad comprising a polishing layer, and one or more transparent window members for optically measuring a polishing state, formed integrally with a part of the polishing layer, wherein each of the transparent window members is formed by laminating at least a soft transparent layer having a micro rubber A hardness of 60 degrees or less and a hard transparent layer having a micro rubber A hardness of 80 degrees or more, and also the soft transparent layer is located at an outermost layer of a polishing surface (Patent Document 1).

There has also been proposed a polishing pad comprising a polishing layer for polishing a material to be polished, and an underlying for supporting the polishing layer, wherein the polishing layer is provided with a first window member through which light is transmitted in a thickness direction, and the underlying layer is provided with a second window member through which light is transmitted in a thickness direction at the position corresponding to the first window member (Patent Document 2).

On the other hand, there has also been made a proposal for preventing a slurry from leaking from a polishing layer to a cushion layer.

For example, there has been proposed a polishing pad in which a transparent sheet is arranged between a pad lower layer and a pad upper layer so as to cover an opening of the pad lower layer and an opening of the pad upper layer (Patent Document 3).

There has also been proposed a polishing pad in which a transparent film is arranged between an upper layer pad and a lower layer pad (Patent Document 4).

As the transparent sheet (transparent film), a sheet (film) including an adhesive layer on both surfaces is used. However, in the case of providing such a sheet (film) between a polishing layer having a light-transmitting region, and a cushion layer, there has been a problem such as deterioration of accuracy of detection of optical end-point.

PRIOR ART DOCUMENTS

Patent Documents

Patent Document 1: JP-A-2003-285259
Patent Document 2: JP-A-2007-44814
Patent Document 3: JP-A-2001-291686
Patent Document 4: JP-A-2003-68686

SUMMARY OF THE INVENTION

Problems to be Solved by the Invention

An object of the present invention is to provide a polishing pad which enables high accuracy optical end-point detection in a state where polishing is carrying out, and which can prevent slurry leakage from a polishing layer to a cushion layer even in the case of being used for a long period. Another object is to provide a method for producing a semiconductor device using the polishing pad.

Means for Solving the Problems

The present inventors have intensively studied so as to solve the above problems and as a result, have found that the objects can be achieved by the below-mentioned polishing pad, thereby leading to complete the present invention.

That is, the present invention relates to a polishing pad in which a polishing layer having a polishing region and a light-transmitting region, and a cushion layer having a through hole are laminated via a double-sided adhesive sheet such that the light-transmitting region and the through hole are laid one upon another, wherein a transparent member is stuck on an adhesive layer of the double-sided adhesive sheet in the through hole.

FIG. 2 is a schematic sectional view showing a structure of a conventional polishing pad. Specifically, a polishing layer 10 having a polishing region 8 and a light-transmitting region 9, and a cushion layer 12 having a through hole 11 are laminated via a double-sided adhesive sheet 15 such that the light-transmitting region 9 and the through hole 11 are laid one upon another. The double-sided adhesive sheet 15 includes an adhesive layer 14 on both surfaces of a transparent sheet 13. Usually, a release sheet is provided on a surface of the adhesive layer 14 before use. A conventional polishing pad 1 is produced by releasing a release sheet provided on a surface of each adhesive layer 14 of the double-sided adhesive sheet 15 and sticking each exposed adhesive layer 14 on the polishing layer 10 and the cushion layer 12.

The reason why a conventional polishing pad is inferior in optical end-point detection accuracy is considered as follows. Since an adhesive surface of the adhesive layer 14 in the through hole 11 is exposed, fine dusts and the like adhere on the adhesive surface upon the production of the polishing pad and the polishing operation, and thus a light transmittance may decrease or reflection of light may occur, resulting in deterioration of optical end-point detection accuracy. When the polishing pad is stuck on the platen, the adhesive surface is roughened by contact with the platen, resulting in deterioration of optical end-point detection accuracy. When a pressure is applied to the light-transmitting region 9 during the polishing operation, the adhesive surface is stuck on the platen to cause distortion of the light-transmitting region 9, resulting in deterioration of optical end-point detection accuracy. It is considered that the above problems are solved when the adhesive layer 14 in the through hole 11 is completely removed after producing the polishing pad. However, it is virtually impossible to completely remove the adhesive layer 14.

According to the polishing pad of the present invention, as shown in FIG. 3, since a transparent member 16 is stuck on the adhesive layer 14 in the through hole 11, the above-mentioned problems do not occur and thus deterioration of optical end-point detection accuracy can be prevented.

The transparent member is preferably a resin film subjected to an anti-reflection treatment and/or a light scattering treatment. Since direct reflection of incident measurement light can be prevented by use of the resin film, high optical end-point detection accuracy can be maintained.

The transparent member is preferably a resin film subjected to an anti-fouling treatment. Since dusts and the like are less likely to adhere on a film surface by use of the resin film, high optical end-point detection accuracy can be maintained.

A resin film having a bandpass function may be optionally used as the transparent member. If the resin film is used, only light having a requisite wavelength can be transmitted by cutting light having an unnecessary wavelength, and thus it is possible to detect only light having a wavelength which is required in optical end-point detection. Therefore, it is advantageous.

The present invention also relates to a method for producing a semiconductor device, the method including the step of polishing a surface of a semiconductor wafer using the polishing pad.

MODE FOR CARRYING OUT THE INVENTION

Figure 3:
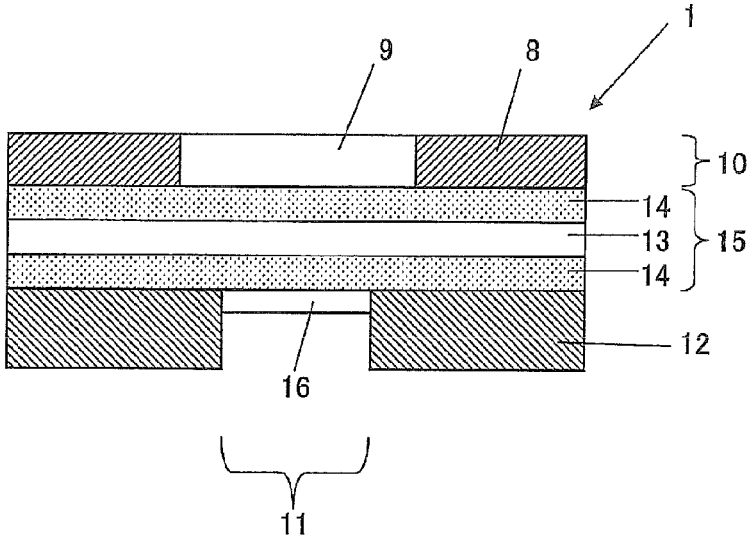
FIG. 3 is a schematic sectional view showing a structure of a polishing pad of the present invention.

FIG. 3 is a schematic sectional view showing a structure of a polishing pad of the present invention. As shown in FIG. 3, a polishing pad 1 of the present invention is a polishing pad in which a polishing layer 10 having a polishing region 8 and a light-transmitting region 9, and a cushion layer 12 having a through hole 11 are laminated via a double-sided adhesive sheet 15 such that the light-transmitting region 9 and the through hole 11 are laid one upon another, and a transparent member 16 is stuck on an adhesive layer 14 in the through hole 11.

There is no particular limitation on a material for forming the light-transmitting region. The material to be used is preferably a material which enables optical end-point detection with high accuracy in a state where polishing is carried out and has a light transmittance of 20% or more, and more preferably 50% or more, over the entire range of 400 to 700 nm in wavelength. Examples of such a material include thermosetting resins such as a polyurethane resin, a polyester resin, a phenol resin, a urea resin, a melamine resin, an epoxy resin and an acrylic resin; thermoplastic resins such as a polyurethane resin, a polyester resin, a polyamide resin, a cellulose-based resin, an acrylic resin, a polycarbonate resin, a halogen containing resin (polyvinyl chloride, polytetrafluoroethylene, polyvinylidene fluoride and the like), polystyrene, and an olefinic resin (polyethylene, polypropylene and the like); rubbers such as a butadiene rubber and an isoprene rubber; photocurable resins curable with irradiation of light such as ultraviolet light and an electron beam; and photosensitive resins. The resins may be used alone or in combination of two or more kinds thereof. The thermosetting resin is preferably cured at a relatively low temperature. When the photocurable resin is used, a photopolymerization initiator is preferably used in combination.

There is no particular limitation on the photocurable resin as long as it is curable by a reaction by means of light. Resins having an ethylenic unsaturated hydrocarbon group are exemplified. Specific examples thereof include polyhydric alcohol-based (meth)acrylates such as diethylene glycol dimethacrylate, tetraethylene glycol diacrylate, hexapropylene glycol diacrylate, trimethylolpropane triacrylate, pentaerythritol triacrylate, 1,6-hexanediol diacrylate, 1,9-nonanediol diacrylate, dipentaerythritol pentaacrylate, trimethylolpropane trimethacrylate and origobutadienediol diacrylate; epoxy(meth)acrylates such as 2,2-bis(4-(meth) acryloxyethoxyphenyl)propane and (meth)acrylic acid adducts of bisphenol A or an epichlorohydrin-based epoxy resin; low molecular unsaturated polyesters such as a condensate of phthalic anhydride-neopentyl glycol-acrylic acid; (meth)acrylic acid adducts of trimethylolpropane triglycidyl ether; urethane(meth)acrylate compounds obtained by a reaction of trimethylhexamethylene diisocyanate, a dihydric alcohol and a (meth)acrylic acid monoester; methoxypolyethylene glycol(meth)acrylate; methoxypolypropylene glycol (meth)acrylate; phenoxypolyethylene glycol(meth)acrylate; phenoxypolypropylene glycol(meth)acrylate; nonylphenoxypolyethylene glycol(meth)acrylate; and nonylphenoxypolypropylene glycol(meth)acrylate. The above resins may be used alone or in combination of two or more kinds thereof.

In order to enhance photocurability of the photocurable resin, a photopolymerization initiator, a sensitizing agent or the like can be added thereto. There is no particular limitation thereon, and such an additive to be used is selected depending on a light source or a wavelength band in use.

In the case where ultraviolet light in the vicinity of i-line (365 nm) is used as a light source, examples of the additive include aromatic ketones such as benzophenone, 4,4'-bis (dimethylamino)benzophenone, 4,4'-bis(diethylamino)benzophenone, 4-methoxy-4'-dimethylaminobenzophenone, 2-benzyl-2-dimethylamino-1-(4-morphorinophenyl)-butane-1-one, 2-ethylanthraquinone and phenanthrenequinone; benzoins such as methylbenzoin and ethylbenzoin; benzyl derivatives such as benzyldimethyl ketal; imidazoles such as 2-(o-chlorophenyl)-4,5-diphenylimidazole dimer, 2-(o-chlorophenyl)-4,5-di(m-methoxyphenyl)imidazole dimer, 2-(o-fluorophenyl)-4,5-phenylimidazole dimer, 2-(o-methoxyphenyl)-4,5-diphenylimidazole dimer, 2-(p-methoxyphenyl)-4,5-diphenylimidazole dimer and 2-(2,4-dimethoxyphenyl)-4,5-diphenylimidazole dimer; acridine derivatives such as 9-phenylacridine and 1,7-bis(9,9'-acridinyl)heptane; and N-phenylglycine. These additives may be used alone or in combination of two or more kinds thereof.

There is no particular limitation on the photosensitive resin, as long as it is a resin causing a chemical reaction by means of light, and specific examples thereof include: (1) polymers each having a compound including an active ethylene group or an aromatic polycyclic compound introduced to a main chain or a side chain thereof, examples of which include polyvinyl cinnamate; an unsaturated polyester obtained by condensation polymerization of p-phenylene diacrylic acid with glycol; cinnamylidene acetic acid esterified with polyvinyl alcohol; and polymers each having a photosensitive functional group such as a cinnamoil group, a cinnamylidene group, a carcon residue, an isocoumarin residue, a 2,5-dimethoxystilbene residue, a stylylpyridinium residue, a tymine residue, a-phenylmaleimide, an anthracene residue or 2-pyron introduced to a main chain or a side chain thereof; (2) polymers each having a diazo group or an azido group introduced to a main chain or a side chain thereof, examples of which include paraformaldehyde condensates with p-diazodiphenylamine, formaldehyde condensates with benzenediazodium-4-(phenylamino)phosphate, formaldehyde condensates with a methoxybenzenediazodium-4-(phenylamino) salt adduct, polyvinyl-p-azidobenzal resins and azidoacrylate; and (3) polymers each having a phenol ester introduced to a main chain or a side chain thereof, examples of which include polymers in which an unsaturated carbon-carbon double bond such as a (meth)acryloyl group is introduced, unsaturated polyester, unsaturated polyurethane, unsaturated polyamide, poly(meth)acrylic acid in which an unsaturated carbon-carbon double bond is introduced through an ester bond to a side chain thereof, epoxy(meth)acrylates and novolak(meth) acrylate.

Various kinds of photosensitive polyimides, photosensitive polyamides, photosensitive polyamideimide, and a combination of a phenol resin and an azido compound can be used. Moreover, an epoxy resin or polyamide to which a chemically crosslinkable site is introduced can be used in combination with a photo-cationic polymerization initiator. Moreover, a natural rubber, a synthetic rubber or a cyclized rubber can be used in combination with a bisazido compound.

The material to be used in the light-transmitting region is preferably a material more excellent in cutting property than the material to be used in the polishing region. The term, cutting property, means a level at which the material is cut during polishing by a material to be polished or a dresser. In the above case, the light-transmitting region does not protrude from the polishing region and a scratch on a material to be polished or a dechuck error during polishing can be prevented.

The material to be used in the light-transmitting region is preferably the material used in the polishing region or a material analogous to the material used in the polishing region in physical properties. Particularly preferred is a polyurethane resin having a high wear resistance, which can suppress light scattering in the light-transmitting region due to dressing marks during polishing.

The polyurethane resin is made of an isocyanate component, a polyol (high-molecular-weight polyol and low-molecular-weight polyol) component and a chain extender.

Examples of the isocyanate component include 2,4-toluene diisocyanate, 2,6-toluene diisocyanate, 2,2'-diphenylmethane diisocyanate, 2,4'-diphenylmethane diisocyanate, 4,4'-diphenylmethane diisocyanate, 1,5-naphthalene diisocyanate, p-phenylene diisocyanate, m-phenylene diisocyanate, p-xylylene diisocyanate, m-xylylene diisocyanate, hexamethylene diisocyanate, 1,4-cyclohexane diisocyanate, 4,4'-dicyclohexylmethane diisocyanate and isophorone diisocyanate. These may be used alone or in combination of two or more kinds thereof.

Examples of the high-molecular-weight polyol include polyether polyols represented by polytetramethylene ether glycol, polyester polyols represented by polybutylene adipate, polyester polycarbonate polyols exemplified by reaction products of polyester glycols such as polycaprolactone polyol and polycaprolactone with alkylene carbonate, polyester polycarbonate polyols obtained by reacting ethylene carbonate with a polyhydric alcohol and reacting the resulting reaction mixture with organic dicarboxylic acid, and polycarbonate polyols obtained by ester exchange reaction of a polyhydroxyl compound with aryl carbonate. These may be used alone or in combination of two or more kinds thereof.

The polyol includes not only the above high-molecular-weight polyols but also low-molecular-weight polyols such as ethylene glycol, 1,2-propylene glycol, 1,3-propylene glycol, 1,4-butane diol, 1,6-hexane diol, neopentyl glycol, 1,4-cyclohexane dimethanol, 3-methyl-1,5-pentane diol, diethylene glycol, triethylene glycol and 1,4-bis(2-hydroxyethoxy) benzene.

Examples of the chain extender include low-molecular-weight polyols such as ethylene glycol, 1,2-propylene glycol, 1,3-propylene glycol, 1,4-butane diol, 1,6-hexane diol, neopentyl glycol, 1,4-cyclohexane dimethanol, 3-methyl-1,5-pentane diol, diethylene glycol, triethylene glycol and 1,4-bis (2-hydroethoxy)benzene; and polyamines such as 2,4-toluene diamine, 2,6-toluene diamine, 3,5-diethyl-2,4-toluene diamine, 4,4'-di-sec-butyl-diaminodiphenyl methane, 4,4'-diaminodiphenyl methane, 3,3'-dichloro-4,4'-diaminodiphenyl methane, 2,2',3,3'-tetrachloro-4,4'-diaminodiphenyl methane, 4,4'-diamino-3,3'-diethyl-5,5'-dimethyl diphenyl methane, 3,3'-diethyl-4,4'-diaminodiphenyl methane, 4,4'-methylene-bis-methyl anthranylate, 4,4'-methylene-bis-anthranylic acid, 4,4'-diaminodiphenyl sulfone, N,N'-di-sec-butyl-p-phenylene diamine, 4,4'-methylene-bis (3-chloro-2,6-diethylaniline), 3,3'-dichloro-4,4'-diamino-5,5'-diethyl diphenyl methane, 1,2-bis(2-aminophenylthio) ethane, trimethylene glycol-di-p-aminobenzoate and 3,5-bis (methylthio)-2,4-toluene diamine. These may be used alone or in combination of two or more kinds thereof. However, since such polyamines are often colored by themselves and resins formed by using the same are also often colored, polyamines are blended preferably in such a range that physical properties and light transmittance do not deteriorate. When the compound having an aromatic hydrocarbon group is used, the light transmittance in the short-wavelength side tends to decrease, and thus such a compound is particularly preferably not used. In the case of a compound in which an electron-donating group such as a halogen group and a thio group or an electron-withdrawing group is attached to an aromatic ring, the light transmittance tends to decrease, and thus such a compound is particularly preferably not used, provided that the compound may be blended in such a range that the required transmittance in the short-wavelength side does not deteriorate.

The proportion of the isocyanate component, the polyol component and the chain extender in the polyurethane resin can be appropriately changed depending on their respective molecular weights, desired physical properties in the light-transmitting region produced therefrom, and the like. The ratio of the number of isocyanate groups in the organic isocyanate to the number of functional groups in total (hydroxyl group+amino group) in the polyol and the chain extender is preferably 0.95 to 1.15, and more preferably 0.99 to 1.10. The polyurethane resin can be produced by known urethane-making techniques such as a melting method and a solution method, but in consideration of cost and working environment, the polyurethane resin is preferably produced by the melting method.

The polymerization procedure for the polyurethane resin can be either a prepolymer method or a one shot method and, from the viewpoints of stability and transparency of the polyurethane resin upon polishing, preferable is the prepolymer method in which an isocyanate terminated prepolymer is synthesized from an organic isocyanate and a polyol in advance, and a chain extender is reacted with the prepolymer. An NCO weight % of the prepolymer is preferably in the range of about 2 to 8 weight %, and more preferably, in the range of about 3 to 7 weight %. When the NCO weight % is less than 2 weight %, reaction curing takes an excessively long time to tend to reduce productivity, while when the NCO weight % exceeds 8 weight %, a reaction velocity is excessively fast to thereby cause incorporation of air, or the like, thereby tending to deteriorate physical characteristics such as transparency and light transmittance. When there are air bubbles in the light-transmitting region, decay of reflected light becomes significant due to light scattering, thereby reducing polishing end-point detection accuracy and film thickness measurement accuracy. Accordingly, in order to remove such air bubbles to make the light-transmitting region without air bubbles, a gas contained in the material is preferably sufficiently removed under reduced pressure at 10 Torr or less before mixing of the material. In the case of a usually used stirring blade mixer, the mixture is stirred at a rotation number of 100 rpm or less so as not to permit air bubbles to be incorporated into it in the stirring step after mixing. The stirring step is also preferably conducted under reduced pressure. When a rotation revolution mixer is used, air bubbles are hardly mixed even in high rotation, and thus a method of stirring and deforming by using this mixer is also preferable.

There is no particular limitation on the method of preparing the light-transmitting region, and the light-transmitting region can be prepared according to known methods. For example, a method wherein a block of the polyurethane resin produced by the method described above is cut in a predetermined thickness by a slicer in a bandsaw system or a planing system, a method that involves casting a resin into a mold having a cavity of predetermined thickness and then curing the resin, a method of using coating techniques and sheet molding techniques, and the like are used.

There is no particular limitation on the shape and size of the light-transmitting region, and the shape and size are preferably similar to the shape and size of the opening of the polishing region. The light-transmitting region may have the size which is equal to, or larger or smaller than, that of the through hole of the cushion layer.

There is no particular limitation on the thickness of the light-transmitting region, and it is preferably that a thickness thereof is equal to or less than that of the polishing region. When the thickness of the light-transmitting region is more than that of the polishing region, there is a possibility that the material to be polished is scared by a protruded portion during polishing. Since the light-transmitting region is deformed by stress acting thereon upon polishing to have an optically large strain, there is a possibility that polishing end-point detection accuracy is reduced. On the other hand, when the thickness of the light-transmitting region is excessively thin, durability is insufficient and a large recess occurs on the upper surface of the light-transmitting region to collect a lot of slurry, thereby causing a possibility to reduce optical end-point detection accuracy.

The Asker D hardness of the light-transmitting region is preferably 30 to 75 degrees. Use of the light-transmitting region of the hardness enables suppression of generation of scratch on the wafer surface and deformation of the light-transmitting region. It is also possible to suppress generation of scar on the light-transmitting region surface, thereby making it possible to stably carry out optical end-point detection with high accuracy. The Asker D hardness of the light-transmitting region is preferably 40 to 60 degrees.

Examples of the material for forming the polishing region include a polyurethane resin, a polyester resin, a polyamide resin, an acrylic resin, a polycarbonate resin, a halogenated resin (polyvinyl chloride, polytetrafluoroethylene, polyvinylidene fluoride or the like), polystyrene, an olefinic resin (polyethylene, polypropylene or the like), an epoxy resin and a photosensitive resin. These may be used alone or in combination of two or more kinds thereof. The material for forming the polishing region may have the composition which is the same as or different from that of the light-transmitting region, and is preferably the same material as that used for forming the light-transmitting region.

The polyurethane resin is a particularly preferable material as the material for forming the polishing region because it is excellent in abrasion resistance and can be used for easily obtaining a polymer having desired physical properties by changing the composition of raw materials.

There is no particular limitation on the isocyanate component used and, for example, the isocyanate component described above can be mentioned.

There is no particular limitation on the high-molecular-weight polyol used and, for example, the high-molecular-weight polyol described above can be mentioned. There is no particular limitation on the number-average molecular weight of the high-molecular-weight polyol, and the number-average molecular weight is preferably about 500 to 2,000 from the viewpoint of the elastic characteristics of the resulting polyurethane. When the number-average molecular weight is less than 500, the polyurethane obtained therefrom does not have sufficient elastic characteristics, thus becoming a brittle polymer. Accordingly, a polishing region produced from this polyurethane is too rigid and can cause scratch on the wafer surface. Further, because of easy abrasion, such polyurethane is not preferable from the viewpoint of the lifetime of the pad. In contrast, when the number-average molecular weight is more than 2000, polyurethane obtained therefrom becomes too soft, and thus a polishing region produced from this polyurethane tends to be inferior in planarizing property.

As the polyol, not only the high-molecular-weight polyols mentioned above, but also the low-molecular-weight polyols mentioned above can be used in combination.

Examples of the chain extender include polyamines such as 4,4'-methylene bis(o-chloroaniline) (MOCA), 2,6-dichloro-p-phenylenediamine, 4,4'-methylene bis(2,3-dichloroaniline), 3,5-bis(methylthio)-2,4-toluenediamine, 3,5-bis(methylthio)-2,6-toluenediamine, 3,5-diethyltoluene-2,4-diamine, 3,5-diethyltoluene-2,6-diamine, trimethylene glycol-di-p-aminobenzoate, polytetramethyleneoxide-di-p-aminobenzoate, 1,2-bis(2-aminophenylthio)ethane, 4,4'-diamino-3,3'-diethyl-5,5'-dimethyldiphenylmethane, N,N'-di-sec-butyl-4,4'-diaminodiphenylmethane, 4,4'-diamino-3,3'-diethyldiphenylmethane, 4,4'-diamino-3,3'-diethyl-5,5'-dimethyldiphenylmethane, 4,4'-diamino-3,3'-diisopropyl-5,5'-dimethyldiphenylmethane, 4,4'-diamino-3,3',5,5'-tetraethyldiphenylmethane, 4,4'-diamino-3,3',5,5'-tetraisopropyldiphenylmethane, m-xylylenediamine, N,N'-di-sec-butyl-p-phenylenediamine, m-phenylenediamine and p-xylylenediamine; and the low-molecular-weight polyol components described above. These may be used alone or in combination of two or more kinds thereof.

The proportion of the isocyanate component, the polyol and the chain extender in the polyurethane resin can be suitably changed depending on their respective molecular weights, desired physical properties of the polishing region produced therefrom and the like. To obtain the polishing region excellent in polishing characteristics, the ratio of the number of isocyanate groups in the isocyanate component to the number of functional groups in total (hydroxyl group+amino group) in the polyol and the chain extender is preferably 0.95 to 1.15, and more preferably 0.99 to 1.10.

The polyurethane resin can be produced by the same method as described above. To the polyurethane resin, a stabilizer such as an antioxidant, a surfactant, a lubricant, a pigment, a filler such as hollow beads, water-soluble particles or emulsion particles, an antistatic agent, abrasive grains and other additives may be optionally added.

The polishing region is preferably made of fine-cell foam. When the fine-cell foam is used, slurry can be retained on fine pores of the surface to increase the rate of polishing.

Examples of the method of finely foaming the polyurethane resin include, but are not limited to, a method of adding hollow beads, a mechanical foaming method and a chemical foaming method. These methods may be used in combination, and a mechanical foaming method using a silicone-based surfactant which is a polyalkyl siloxane/polyether copolymer is particularly preferable. As the silicone-based surfactant, SH-192 and L-5340 (manufactured by Toray Dow Corning Silicone Co., Ltd.) can be mentioned as a preferable compound.

An example of the method of producing fine cell polyurethane foam will be described below. The method of producing such polyurethane foam has the following steps.

1) Foaming Step of Preparing Air Bubble Dispersion of Isocyanate-Terminated Prepolymer A silicone-based surfactant is added to an isocyanate-terminated prepolymer (first component) followed by stirring in the presence of a nonreactive gas, and the nonreactive gas is dispersed as fine cells to form an air bubble dispersion. When the prepolymer is in a solid form at a normal temperature, the prepolymer is used after melted by pre-heating to an appropriate temperature.

2) Curing Agent (Chain Extender) Mixing Step A chain extender (second component) is added to the air bubble dispersion, followed by mixing under stirring to give a foaming reaction solution.

3) Casting Step

The foaming reaction solution is poured into a mold.

(4) Curing Step

The foaming reaction solution poured into the mold is reaction-cured by heating.

The nonreactive gas to be used for forming fine cells is preferably not combustible, and specific examples thereof include noble gases such as nitrogen, oxygen, a carbon dioxide gas, a rare gas such as helium and argon, and a mixed gas thereof, and air dried to remove water is most preferable in respect of cost.

As a stirrer for dispersing the nonreactive gas in the form of fine air bubbles into the silicone-based surfactant-containing isocyanate-terminated prepolymer, known stirrers can be used without particular limitation, and specific examples thereof include a homogenizer, a dissolver and a twin-screw planetary mixer. There is no particular limitation on the shape of a stirring blade of the stirrer, and a whipper-type stirring blade is preferably used because fine air bubbles are obtained.

In a preferable aspect, different stirrers are used in stirring for forming the air bubble dispersion in the stirring step and in stirring for mixing the added chain extender in the mixing step. In particular, stirring in the mixing step may not be stirring for forming air bubbles, and a stirrer not generating incorporation of large air bubbles is preferably used. Such a stirrer is preferably a planetary mixer. The same stirrer may be used in the stirring step and the mixing step, and stirring conditions such as rotation rate of the stirring blade are preferably regulated as necessary.

In the method of producing the polyurethane foam, heating and post-curing of the foam obtained after casting the foaming reaction solution into a mold and reacting it until the solution lost fluidity are effective in improving the physical properties of the foam, and are extremely preferable. The foaming reaction solution may be poured into a mold and immediately post-cured in a heating oven, and even under such conditions, heat is not immediately conducted to the reactive components, and thus the diameters of cells are not increased. The curing reaction is preferably conducted at normal pressure to stabilize the shape of cells.

In the production of the polyurethane resin, a known catalyst for promoting a polyurethane reaction, such as tertiary amine- or organotin-based catalysts, may be used. The type and amount of the catalyst added are selected in consideration of flow time in casting in a predetermined mold after the mixing step.

The production of the polyurethane foam may be in a batch system where each component is weighed out, charged into a vessel and mixed or in a continuous production system where each component and a nonreactive gas are continuously supplied to and stirred in a stirring apparatus and the resulting air bubble dispersion is sent to produce molded articles.

The polishing region is produced by cutting the prepared polyurethane foam as described above into pieces of predetermined size.

The polishing region is preferably provided with an uneven structure (grooves, holes) for holding and renewing a slurry, on the surface of the polishing side contacting with the wafer. In the case where the polishing region is formed with a fine foam, many openings are on the polishing surface and work so as to hold the slurry. The uneven structure is preferably provided on the surface of the polishing side in order to effectively achieve more holdability and renewal of the slurry, and to prevent induction of dechuck error due to adsorption of the wafer, breakage of a wafer or decrease in polishing efficiency. There is no particular limitation on the shape of the uneven structure as long as the structure is such that the slurry is retained and renewed, and examples thereof include XY latticed grooves, concentric circle-shaped grooves, through holes, non-through holes, polygonal prism, cylinder, spiral grooves, eccentric grooves, radial grooves, and a combination of these grooves. There is no particular limitation on the groove pitch, groove width and groove thickness, and they are appropriately selected to form the structure. These uneven structures are generally those having regularity, and the groove pitch, groove width and groove depth can also be changed at each certain region in order to make holdability and renewal of the slurry desirable.

There is no particular limitation on the thickness of the polishing region, and the thickness thereof is usually about 0.8 to 4 mm, and preferably 1.5 to 2.5 mm. Examples of the method of preparing the polishing region of this thickness include a method wherein a block of the fine-cell foam is cut in predetermined thickness by a slicer in a bandsaw system or a planing system, a method that involves casting resin into a mold having a cavity of predetermined thickness and curing the resin, and a method of using coating techniques and sheet molding techniques.

The cushion layer compensates for characteristics of the polishing region. The cushion layer is required for satisfying both planarity and uniformity which are in a tradeoff relationship in CMP. Planarity refers to flatness of a pattern region upon polishing a material to be polished having fine unevenness generated upon pattern formation, and uniformity refers to the uniformity of the whole of a material to be polished. Planarity is improved by the characteristics of the polishing region, while uniformity is improved by the characteristics of the cushion layer. The cushion layer in the polishing pad of the present invention is preferably softer than the polishing region.

There is no particular limitation on the material for forming the cushion layer, and examples of such a material include a nonwoven fabric such as a polyester nonwoven fabric, a nylon nonwoven fabric or an acrylic nonwoven fabric; a nonwoven fabric impregnated with a resin, such as a polyester nonwoven fabric impregnated with polyurethane; a polymer resin foam such as polyurethane foam or polyethylene foam; a rubber resin such as a butadiene rubber or an isoprene rubber; and a photosensitive resin.

There is no limitation on the method for producing a polishing pad of the present invention. For example, the polishing pad can be produced, for example, by sticking a polishing region provided with an opening, and a cushion layer provided with a through hole to an adhesive layer of a double-sided adhesive sheet, respectively, such that the opening and the through hole are laid one upon another; sticking a light-transmitting region on the adhesive layer in the opening of the polishing region; and then sticking a transparent member on the adhesive layer in the through hole of the cushion layer.

In the methods for producing a polishing pad, there is no particular limitation on the means for forming the opening in the polishing region and the through hole in the cushion layer, and examples of the means include a method for forming them by pressing or cutting using a tool, a method using a laser such as a carbon oxide gas laser, and a method in which raw materials are poured into a mold provided with an opening or a through hole, and then cured. There is no limitation on the size and shape of an opening and a through hole.

The double-sided adhesive sheet has a general constitution in which an adhesive layer is provided on both surfaces of a base material such as a nonwoven fabric or a film, and is generally called a double-sided tape. Examples of the composition of the adhesive layer include a rubber-based adhesive and an acrylic adhesive. Usually, a release sheet is provided on the adhesive layer of the double-sided adhesive sheet.

The transparent member is preferably formed of a material having a light transmittance which is equivalent to that of the light-transmitting region, so as to prevent deterioration of optical end-point detection accuracy, and examples of the material thereof include glass, and a resin film capable of transmitting light. It is particularly preferable to use a resin film formed of the same material as that of the light-transmitting region. There is no limitation on the thickness of the transparent member, and the thickness is preferably as thin as possible, taking the light transmittance into consideration.

It is preferred to use, as the transparent member, a resin film subjected to an anti-reflection treatment and/or a light scattering treatment.

The anti-reflection treatment can be carried out, for example, by providing, on a film, an anti-reflection film having a refractive index lower than that of the film. Examples of the material forming the anti-reflection film include a resin-based material such as an ultraviolet curable acrylic resin, a hybrid-based material in which inorganic fine particles such as colloidal silica are dispersed in a resin, and a sol-gel-based material using a metal alkoxide such as tetraethoxysilane or titanium tetraethoxide. To impart anti-fouling property of a film surface, each material having fluorine groups may be used.

The light scattering treatment can be carried out, for example, by imparting a fine uneven structure to the surface of the film by an appropriate method, for example, a roughening method by a sandblasting or embossing method, or a method of blending transparent fine particles. A light scattering film may be separately provided on the film. Examples of the fine particles include inorganic fine particles such as silica, alumina, titania, zirconia, tin oxide, indium oxide, cadmium oxide and antimony oxide, each having an average particle size of 0.5 to 50 μm; and organic fine particles (containing beads) made of a crosslinked or uncrosslinked polymer.

As the transparent member, a resin film subjected to an anti-fouling treatment may be used. The anti-fouling treatment can be carried out, for example, by providing a fluorine resin film on a film.

As the transparent member, a resin film having a bandpass function may also be used. The bandpass function refers to a function of selectively transmitting light having a specific wavelength from multi-color light, and blocking (reflecting and absorbing) light other than light having the other wavelength. Examples of the resin film having a bandpass function include a colored film such as cellophane.

A double-sided tape may be provided on a surface on which a platen of the cushion layer is adhered.

Figure 1:
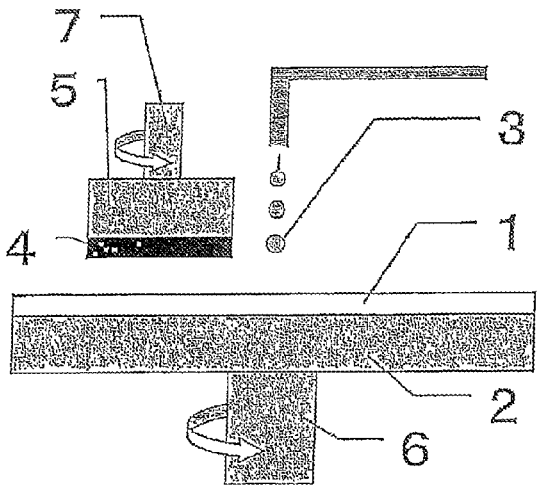
FIG. 1 is a schematic view showing an example of a polishing apparatus used in CMP polishing.
Figure 2:
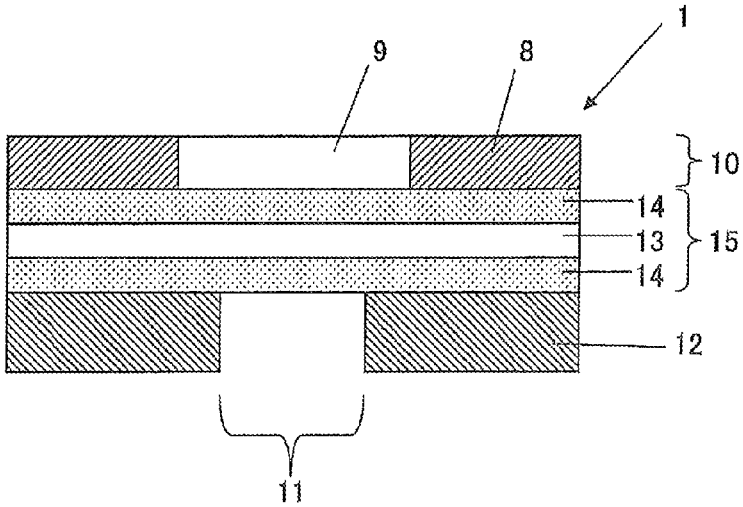
Fig.2 Background Art
FIG. 2 is a schematic sectional view showing a structure of a conventional polishing pad.

A semiconductor device is produced through the step of polishing a surface of a semiconductor wafer using the polishing pad. The semiconductor wafer is generally obtained by laminating a wiring metal and an oxide film on a silicone wafer. There is no limitation on the polishing method and polishing apparatus of the semiconductor wafer. For example, as shown in FIG. 1, polishing is carried out using a polishing apparatus provided with a polishing platen 2 for supporting a polishing pad 1, a supporting stand (polishing head) 5 for supporting a polished wafer 4, a backing material for uniformly pressurizing a wafer, and a mechanism of feeding an abrasive 3. The polishing pad 1 is fitted with the polishing platen 2, for example, by sticking with a double-sided tape. The polishing platen 2 and the supporting stand 5 are provided with rotating shafts 6 and 7, respectively, and are arranged such that the polishing pad 1 and the polished material 4, both of which are supported by them, are opposed to each other. The supporting stand 5 is provided with a pressurizing mechanism for pressing the polished material 4 against the polishing pad 1. In the case of polishing, while rotating the polishing platen 2 and the supporting stand 5, polishing is carried out by pressing the semiconductor wafer 4 against the polishing pad 1 with feeding a slurry. There is no limitation on the flow rate of a slurry, polishing load, rotation number of a polishing platen and rotation number of wafer, and polishing is carried out by appropriately adjusting.

Protrusions on the surface of the semiconductor wafer 4 are thereby removed and polished flatly. Thereafter, a semiconductor device is produced therefrom through dicing, bonding, packaging and the like. The semiconductor device is used in an arithmetic processor, a memory and the like.

EXAMPLES

Hereinafter, the Examples illustrating the constitution and effect of the present inventions are described.

Example 1

Preparation of Light-Transmitting Region

Polyester polyol (having a number average molecular weight of 2,400) (128 parts by weight) made of adipic acid, hexanediol and ethylene glycol was mixed with 30 parts by weight of 1,4-butanediol, and then the temperature of the mixed solution was controlled to 70° C. To this mixed solution, 100 parts by weight of 4,4'-diphenylmethane diisocyanate controlled to the temperature of 70° C. in advance, followed by stirring for about 1 minute. Then, the mixed solution was poured into a vessel maintained at 100° C. and post curing was carried out at 100° C. for 8 hours to prepare a polyurethane resin. Using the prepared polyurethane resin, a light-transmitting region (measuring 56 mm in length, 20 mm in width, and 1.25 mm in thickness) was prepared by injection molding.

[Preparation of Polishing Region]

In a reaction vessel, 100 parts by weight of a polyether-based prepolymer (Adiprene L-325, manufactured by Uniroyal Chemical Corporation, with an NCO concentration of 2.22 meq/g) was mixed with 3 parts by weight of a silicone-based nonionic surfactant (SH192, manufactured by Dow Corning Toray Silicone Co., Ltd.), and then the temperature of the mixture was controlled at 80° C. The mixture was vigorously stirred at a rotation number of 900 rpm for about 4 minutes with a stirring blade so that air bubbles were incorporated into the reaction system. To the reaction system, 26 parts by weight of 4,4'-methylenebis(o-chloroaniline) (IHARACUAMINE MT, manufactured by IHARA CHEMICAL INDUSTRY CO., LTD.) melted at 120° C. in advance was added. Thereafter, the reaction system was continuously stirred for about 1 minute and the reaction solution was poured into a pan type open mold. When the reaction solution lost fluidity, it was put into an oven and postcured at 110° C. for 6 hours to obtain a polyurethane resin foam block. The polyurethane resin foam block was sliced with a bandsaw type slicer (manufactured by Fecken-Kirfel) to obtain a polyurethane resin foam sheet (having a specific gravity of 0.86 and a hardness D of 52 degrees). Then, the sheet was surface-buffed to a predetermined thickness with a buffing machine (manufactured by AMITEC Corporation) to obtain a sheet with an adjusted thickness precision (having a thickness of 1.27 mm). Using a recessing machine (manufactured by TohoKoki Co., Ltd.), concentric circular grooves (each measuring 0.25 mm in groove width, 0.45 mm in groove depth, and 1.5 mm in groove pitch) were formed on the surface of the buff-treated sheet. The sheet was punched into a disk with a size of 60 cm in diameter. Thereafter, an opening (measuring 56 mm×20 mm) was formed at a position which was about 12 cm away from the center of the punched sheet, to prepare a polishing region.

[Preparation of Polishing Pad]

Using a laminator, a double-sided tape (a double tack tape, manufactured by Sekisui Chemical Co., Ltd.) was stuck to a surface on the other side of the recessed surface of the prepared polishing region to prepare a polishing region attached with a double-sided tape.

Using a laminator, a double-sided tape for sticking onto a polishing platen was stuck to one surface (a surface of a polishing platen) of a cushion layer made of a surface-buffed and corona-treated polyethylene foam (TORAYPEF with a thickness of 0.8 mm, manufactured by TORAY INDUSTRIES, INC.), followed by punching into a size with a diameter of 60 cm to prepare a cushion layer attached with a double-sided tape. A through hole (measuring 50 mm×14 mm) was formed at a position which was about 12 cm away from the center of the cushion layer attached with a double-sided tape.

The polishing region attached with a double-sided tape was stuck to the cushion layer attached with a double-sided tape such that an opening and a through hole were laid one upon another, and the prepared light-transmitting region was stuck to the adhesive layer in the opening. Thereafter, a transparent member (polyethylene terephthalate film measuring 50 mm in length, 14 mm in width, and 50 μm in thickness) was stuck to the adhesive layer in the through hole to prepare a polishing pad.

Example 2

Preparation of Polishing Pad

A release film on one surface of a double-sided tape including a release film (having a thickness of 38 μm) made of polyethylene terephthalate on both surfaces (a double tack tape, manufactured by Sekisui Chemical Co., Ltd.) was released, thereby exposing an adhesive layer. Using a laminator, the adhesive layer was stuck to a surface on the other side of the recessed surface of the polishing region prepared in Example 1 to prepare a polishing region attached with a double-sided tape. The light-transmitting region prepared in Example 1 was stuck to the adhesive layer in the opening of the polishing region attached with a double-sided tape to prepare a polishing layer attached with a double-sided tape. Thereafter, a transparent member (measuring 50 mm×14 mm) was formed by making a cut at the portion corresponding to the light-transmitting region of the release film of the other surface of the double-sided tape using a Thomson blade, thereby releasing the release film other than the transparent member, and thus the adhesive layer was exposed.

Using a laminator, a double-sided tape for sticking to a polishing platen was stuck to one surface (a surface of a polishing platen) of a cushion layer made of a surface-buffed and corona-treated polyethylene foam (TORAYPEF with a thickness of 0.8 mm, manufactured by TORAY INDUSTRIES, INC.), followed by punching into a size with a diameter of 60 cm to prepare a cushion layer attached with a double-sided tape. A through hole (measuring 50 mm×14 mm) was formed at a position which was about 12 cm away from the center of the cushion layer attached with a double-sided tape.

Then, the cushion layer attached with a double-sided tape was stuck to the exposed adhesive layer of the polishing layer attached with a double-sided tape such that the transparent member and the through hole were laid one upon another to produce a polishing pad.

Example 3

In the same manner as in Example 1, except that an anti-reflection film (REALOOK, manufactured by NOF Corporation) was used as the transparent member, a polishing pad was prepared.

Comparative Example 1

In the same manner as in Example 1, except that the transparent member was not stuck to the adhesive layer in the through hole, a polishing pad was prepared.

(Evaluation Method)

Using a polishing apparatus SPP600S (manufactured by Okamoto Machine Tool Works, Ltd.), the prepared polishing pad was adhered onto a polishing platen. An 8 inch dummy wafer was polished for 1 hour. Polishing conditions were such that a silica slurry (SS12, manufactured by Cabot Microelectronics Corporation) was added as a slurry during polishing at a flow rate of 150 ml/min, a polishing load was 350 g/cm$^2$, a rotation number of a polishing platen was 35 rpm and a rotation number of a wafer was 30 rpm. Thereafter, the polishing pad was released from the polishing platen and visual observation was conducted so as to confirm whether or not dusts were stuck to a transparent member or an adhesive layer in a through hole of a cushion layer, and its surface was roughened. In the polishing pads of Examples 1 to 3, adhesion of dusts or roughening of the surface was not recognized. In contrast, in the polishing pad of Comparative Example 1, both adhesion of dusts and roughening of the surface were recognized. It is considered that fine dusts adhered onto the adhesive layer during the preparation of the polishing pad and the polishing operation. It is also considered that the surface of the adhesive layer was roughened by contacting with or adhering onto the polishing platen when the polishing pad was stuck to the polishing platen, or during the polishing operation.

INDUSTRIAL APPLICABILITY

The polishing pad of the present invention is used for planarization of optical materials such as a lens and a reflecting mirror; a silicon wafer; a glass substrate and an aluminum substrate for a hard disk; and a material to which high surface flatness of common metal polishing processing is required. The polishing pad of the present invention is suited for use in the step of planarizing a silicone wafer, and a device in which an oxide layer, a metal layer and the like are formed on the silicone wafer before laminating/forming these oxide and metal layers.

DESCRIPTION OF REFERENCE SIGN

1: Polishing pad
2: Polishing platen
3: Abrasive (Slurry)
4: Material to be polished (Semiconductor wafer)
5: Supporting stand (Polishing head)
6, 7: Rotating shafts
8: Polishing region
9: Light-transmitting region
10: Polishing layer
11: Through hole
12: Cushion layer
13: Transparent sheet
14: Adhesive layer
15: Double-sided adhesive sheet
16: Transparent member

The invention claimed is:

1. A polishing pad in which a polishing layer having a polishing region and a light-transmitting region, and a cushion layer having a through hole are laminated via a double-sided adhesive sheet having a transparent sheet and upper and lower adhesive layers formed on both surfaces of the transparent sheet, respectively, such that the light-transmitting region and the through hole are laid one upon another, said light-transmitting region being a window formed in the polishing layer, surrounded by the polishing region, and being constituted by a light-transmitting resin attached to an upper face of the upper adhesive layer of the double-sided adhesive sheet, wherein a transparent member is stuck on a lower face of the lower adhesive layer, inside the through hole formed in the cushion layer, opposite to an upper face of the lower adhesive layer adhering to the transparent sheet.

2. The polishing pad according to claim 1, wherein the transparent member is a resin film subjected to an anti-reflection treatment and/or a light scattering treatment.

3. The polishing pad according to claim 1, wherein the transparent member is a resin film subjected to an anti-fouling treatment.

4. The polishing pad according to claim 1, wherein the transparent member is a resin film having a bandpass function.

5. A method for producing a semiconductor device, comprising the step of polishing a surface of a semiconductor wafer using the polishing pad according to claim 1.

* * * * *